US006543779B2

(12) United States Patent
Yiu

(10) Patent No.: US 6,543,779 B2
(45) Date of Patent: Apr. 8, 2003

(54) DART BOARD

(76) Inventor: Chih-Hao Yiu, 6-2 Floor, No. 160, Sec. 1, Chung-Gang Rd., Taichung City (TW)

( * ) Notice: Subject to any disclaimer, the term of this patent is extended or adjusted under 35 U.S.C. 154(b) by 0 days.

(21) Appl. No.: 09/793,255

(22) Filed: Feb. 26, 2001

(65) Prior Publication Data

US 2001/0006277 A1 Jul. 5, 2001

Related U.S. Application Data

(63) Continuation-in-part of application No. 09/406,957, filed on Sep. 28, 1999, now abandoned.

(51) Int. Cl.[7] ..... F41J 3/00
(52) U.S. Cl. ..... 273/408
(58) Field of Search ..... 273/403, 404, 273/407, 408

(56) References Cited

U.S. PATENT DOCUMENTS 3,309,091 A * 3/1967 Haecker ..... 273/408
4,239,573 A * 12/1980 Wu ..... 273/408

FOREIGN PATENT DOCUMENTS

GB 711536 * 10/1978 ..... 273/403
GB 1527631 * 10/1978 ..... 273/408

* cited by examiner

*Primary Examiner*—Mark S. Graham
(74) *Attorney, Agent, or Firm*—Charles E. Baxley

(57) ABSTRACT

A dart board includes a backing board from which a plurality of tightly overlapped sheets of artificial material extend and each of the sheets has a lot of slits defined therethrough. The slits extend in a direction which is perpendicular to the backing board. When a tip of a dart is inserted into the dart board, the slits expand and provide the sheets flexibility so that after the dart is removed, the sheets bounce back without leaving a hole in the dart board.

6 Claims, 8 Drawing Sheets

DART BOARD

This applicant is a Continuation-In-Part application of U.S. patent application Ser. No. 09/406,957, filed Sep. 28, 1999, abandoned, to Yiu. The dart board is composed of a plurality of spirally rolled artificial thin sheets so that the tip of a dart will be securely clamped by the spirally rolled sheet and no hole will be left in the dart board after the dart is removed from the dart board.

FIELD OF THE INVENTION

BACKGROUND OF THE INVENTION

A conventional dart board 12 is shown in FIGS. 7 and 8 and includes a plurality of fibers 13 which are connected together adjacently to a back board 10. A plurality of panels 11 is used to separate the area of the dart board into sections each section represents a score section. When a dart 14 hits on the dart board 12, the tip 141 inserted the bundle of fibers 13. When the tip 141 is removed from the dart board 12, the fibers 13 will return to their original position so that there will be no recesses shown in the dart board 12. As shown in FIG. 8, the dart 14 contacts the fibers 13 at many individual and smooth points so that the dart 14 could drop from the dart board 12 if the tip 141 is not inserted into the dart board 12 deep enough. Furthermore, it is difficult to combine the fibers 13 together as bundles and to adhere the fibers 13 to the back board 10. Besides, the fibers 13 are easily broken by the tip of the dart 14 especially when the dart 14 hits the dart board 12 at an angle of the surface of the dart board 12. This accelerates the consumption of the dart boards 12.

U.S. Pat. No. 3,309,091 to Haecker disclosed a dart board constructed of tightly spirally wound artificial material so that the dart board includes a plurality of concentric circles. However, the tightly spirally wound artificial material has no flexibility so that when a dart hits the dart board at an angle, the structural strength constructed by the tightly wound artificial material could bounce the dart off, or the artificial material will be broken and left a hole in the surface of the dart board. In other words, when the dart hits the dart board at an angle, there is no gap to allow the tip of the dart to penetrate, the tip has to break through the tightly wound artificial material so that it is not easily to penetrate the artificial material or the tip leaves a hole in the surface of the dart board.

Great British patent 000794 to Herr disclosed a dart board that is constructed by rolled corrugated cardboard or paper. The dart board is "formed of a relatively narrow strip 21 of corrugated cardboard or paper which is wound round in a spiral to form the disk shaped board". The dart board has a large number of spaces into due to the corrugations so as to easily receive the dart board. Nevertheless, because the large number of spaces open to the surface of the dart board, the surface of the dart board is actually composed of a lot of concentric circular rings and wave-shaped members connected between the concentric rings. The spaces are defined between the circular rings and the wave-shaped members. This specific structure is not advantageous for holding the tip of the dart because of the spaces. Besides, the wave-shaped members or the corrugations are easily broken by the dart and holes are left in the surface of the dart board. Furthermore, the wave-shaped members or the corrugations in the corrugated cardboard or paper is adhered between a top sheet and a bottom sheet so that, basically, the wave-shaped members or the corrugations are restricted and cannot be deformed at a larger scale. This limits the flexibility and reduces the ability of holding the tip of the dart and holes will be left after the dart is removed from the dart board. The spaces defined between the circular rings and the wave-shaped members are normally opened toward the users and because the wave-shaped members are secured on the bottom sheet so that then wave-shaped members actually provide only limited flexibility. In other words, if a force applied to the wave-shaped members are too large to deform the wave-shaped members in a large scale, the wave-shaped members tend to be broken or separated from the bottom sheet.

The present invention intends to provide a dart board which is composed of a plurality of tubes connected adjacently and each tube is constructed by a spirally rolled sheet of artificial material and each sheet of artificial material has slit defined therethrough.

SUMMARY OF THE INVENTION

In accordance with one aspect of the present invention, there is provided a dart board and comprises a backing board and a plurality of tightly gathered sheets of artificial material are connected to the backing board at a first end thereof. Each of the sheets of artificial material has a lot of slits defined therethrough.

The primary object of the present invention is to provide a dart board that is composed of a plurality of compressed sheets of artificial material and each sheet has a plurality of slits defined therein.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
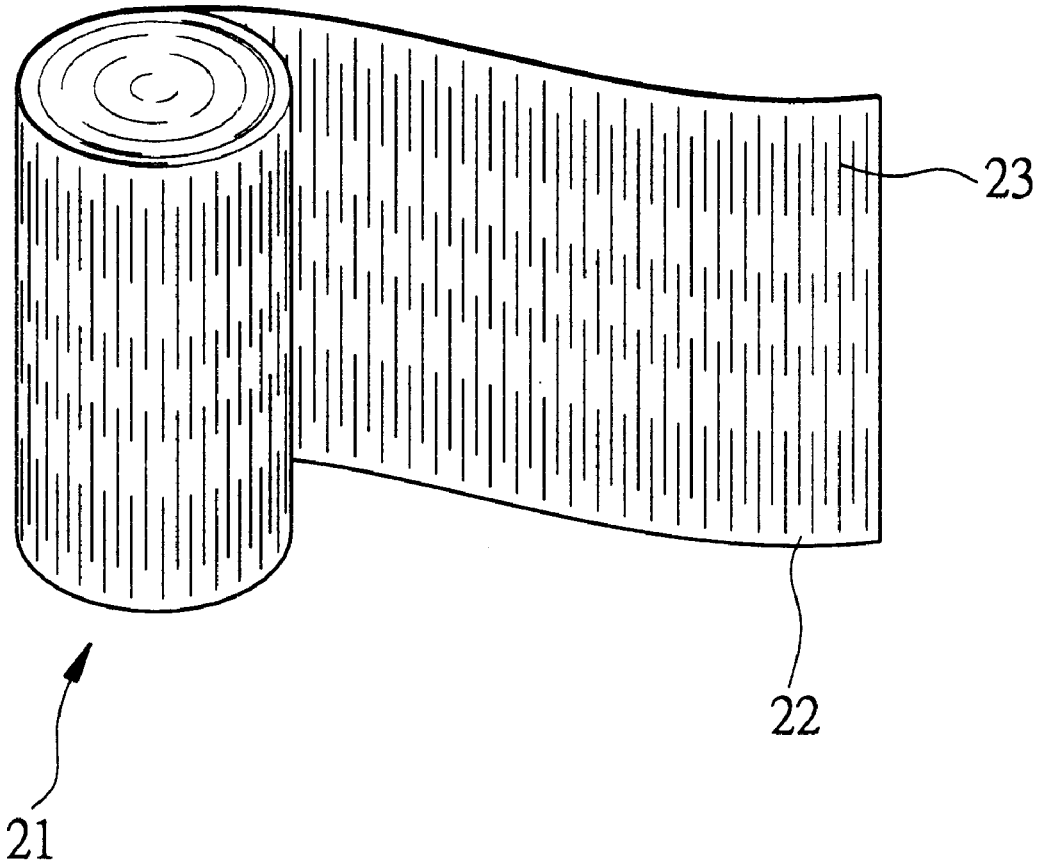
FIG. 1 is an illustrative view to show the tube of the dart board of the present invention, wherein the tube is composed of a spirally wound sheet of artificial material and each of the sheet has slits defined therein.
Figure 2:
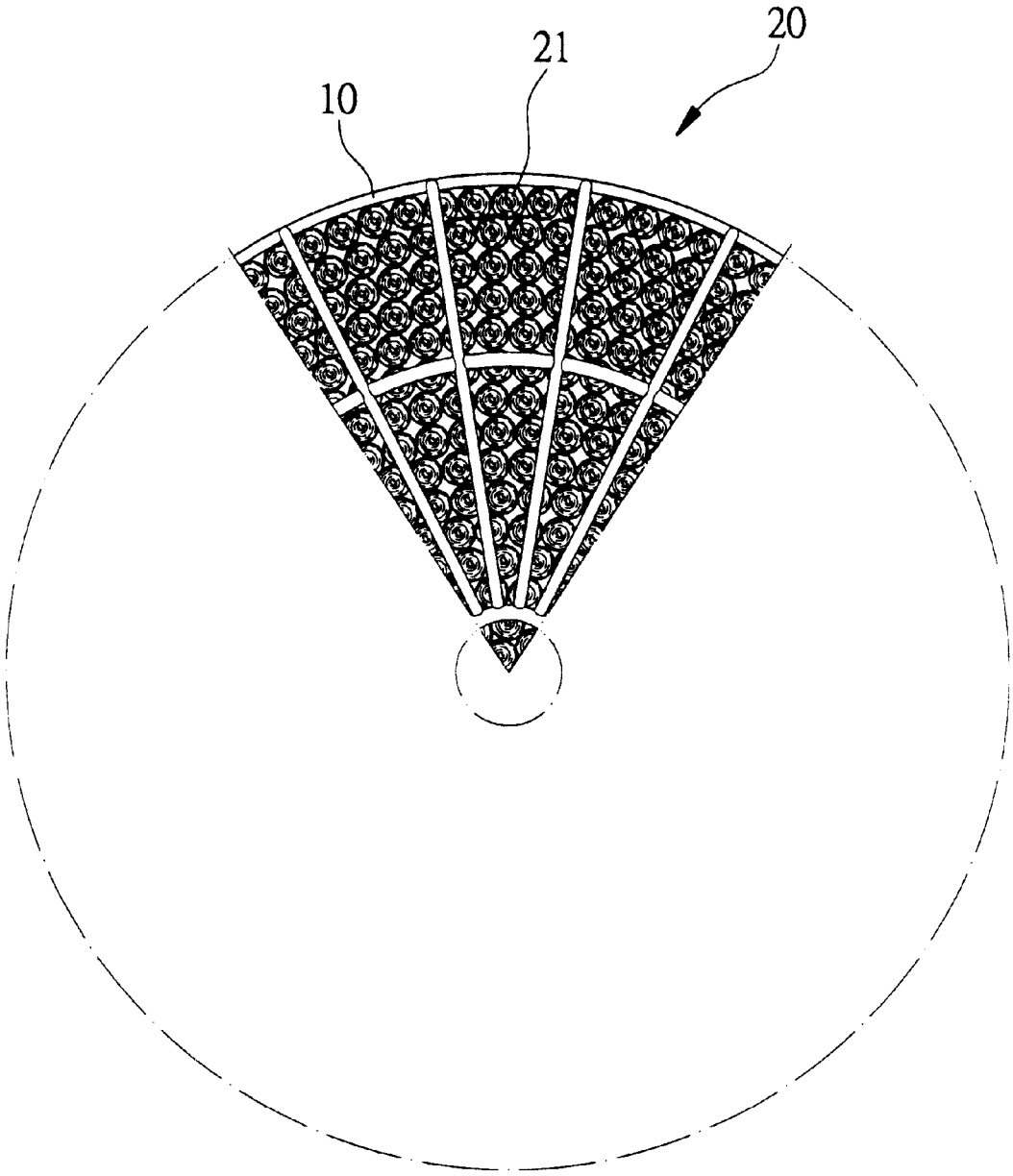
FIG. 2 is an illustrative view to show the dart board of the present invention.

Referring to FIGS. 1 and 2, a dart board 20 in accordance with the present invention comprises a backing board 10 and a plurality sheets of artificial material fixedly connected to the backing board 10 at a front end thereof. The sheets of the artificial material 22 are pressed and overlapped tightly to form a solid dart board 20.

Figure 3:
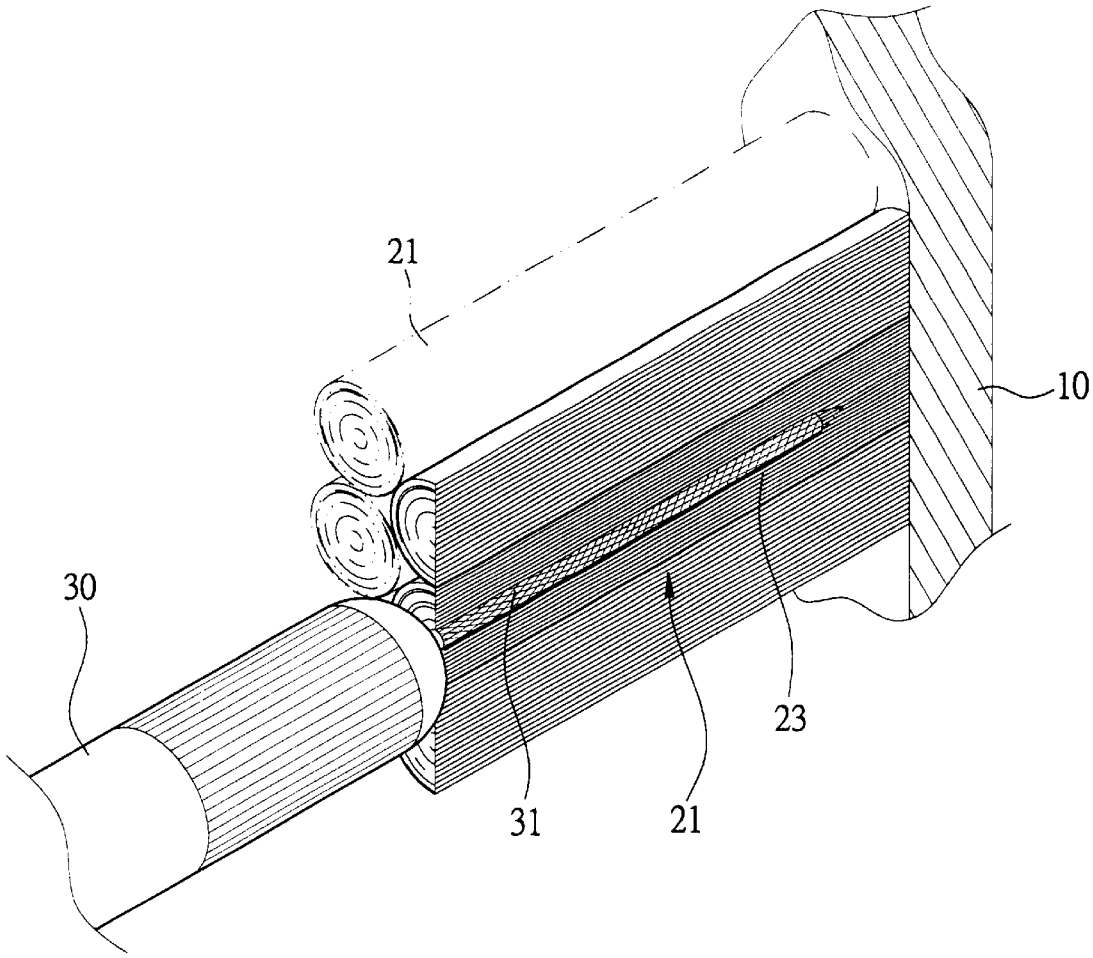
FIG. 3 is an illustrative view to show the tip of a dart is inserted into a tube of the dart board.

In the preferred embodiment of the dart board 20 includes a plurality of tubes 21 connected to the backing board 10 at a first end thereof. A second end of each of said tubes 21 forms the surface of the dart board 20. All the tubes 21 are located adjacently and tightly with each other. Each tube 21 is made by a tightly spirally wound sheet of artificial material 22 or any suitable material, and each of the sheet of artificial material 22 has a plurality of slits 23 defined therethrough. These slits 23 are located alternately with each other and extend toward a direction which is perpendicular to a surface of the backing board 10. When the sheet of artificial material 22 is expanded, the slits 23 are expanded to form holes 23 through the sheet of artificial material 22. As shown in FIG. 3, when the tip 31 of a dart 30 inserts into the dart board 20, the layers of the sheet of artificial material 22 enclosing the tip 31 of the dart is radially expanded and the slits 23 are also expanded to become holes 23. The holes 23 can be narrowed and return the holes 23 to slits 23 because the flexible nature of the tightly and spirally wound structure. By this way, no holes will be left in the surface of the dart board after the dart 30 is removed from the dart board.

Figure 4:
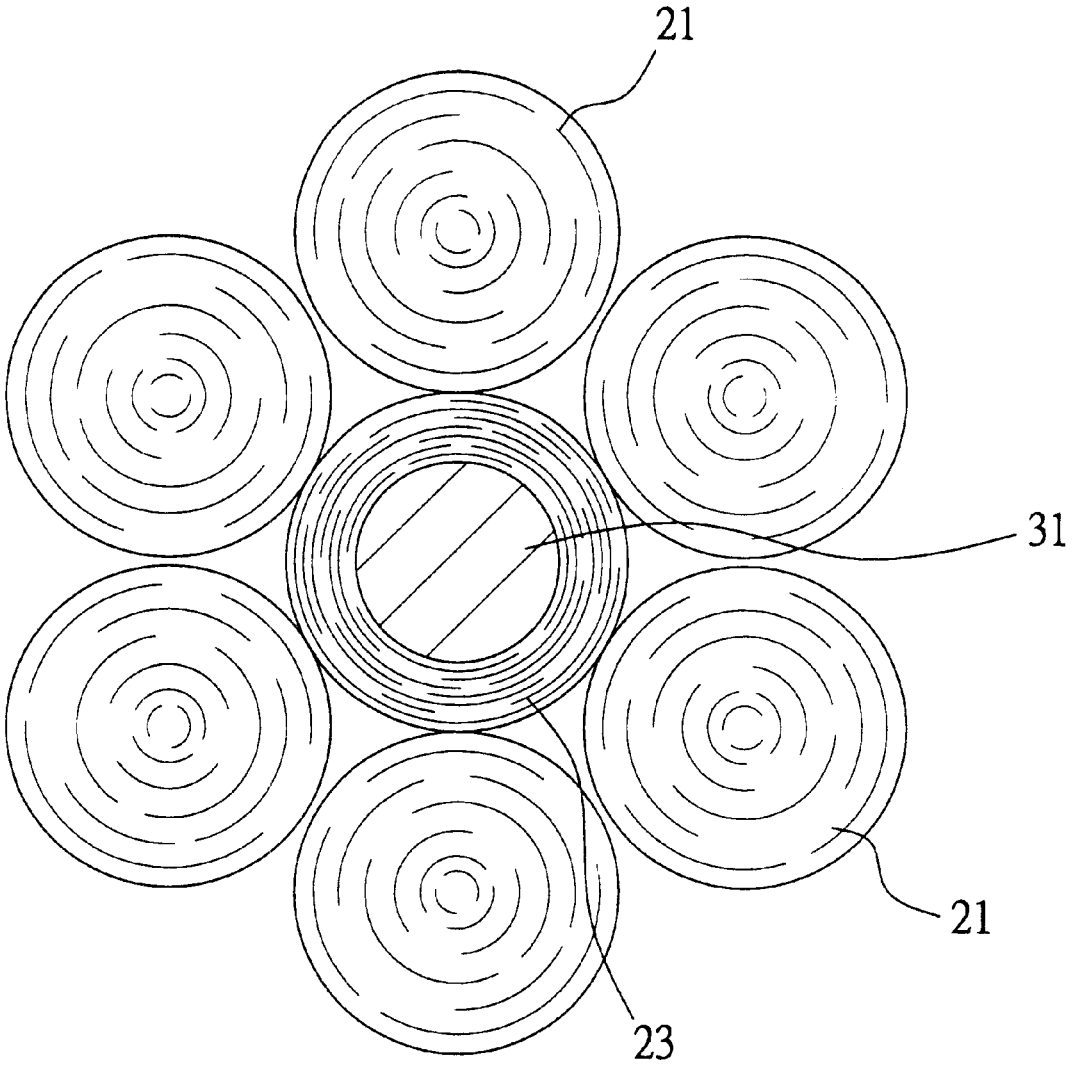
FIG. 4 is an illustrative view to show when the tip of the dart hits on the dart board, the tip of the dark is enclosed by the spirally rolled sheet of artificial material having slits.

FIG. 4 shows that the tip 31 of the dart 30 is enclosed by the spirally wound sheet of artificial material 22 which is expanded radially and applies an inward force to the tip 31 to hold the dart 30 on the dart board 20. The flexibility of the sheet of artificial material 22 let the expanded tube 21 to return back to its original shape when the tip 31 is removed from the tube 21. Therefore, there would be no holes or recesses left in the dart board 20. Unlike the corrugations as disclosed in GB 000794, the slits 23 of the present invention can be expanded large enough to let the dart board receive any size of the dart 30 and no holes will be left in the dart board 20. The slits 23 cannot be seen by the players and no spaces like those disclosed in GB 000794 can be seen in the surface of the dart board. In other words, the surface of the dart board 20 has no spaces or holes.

Figure 5:
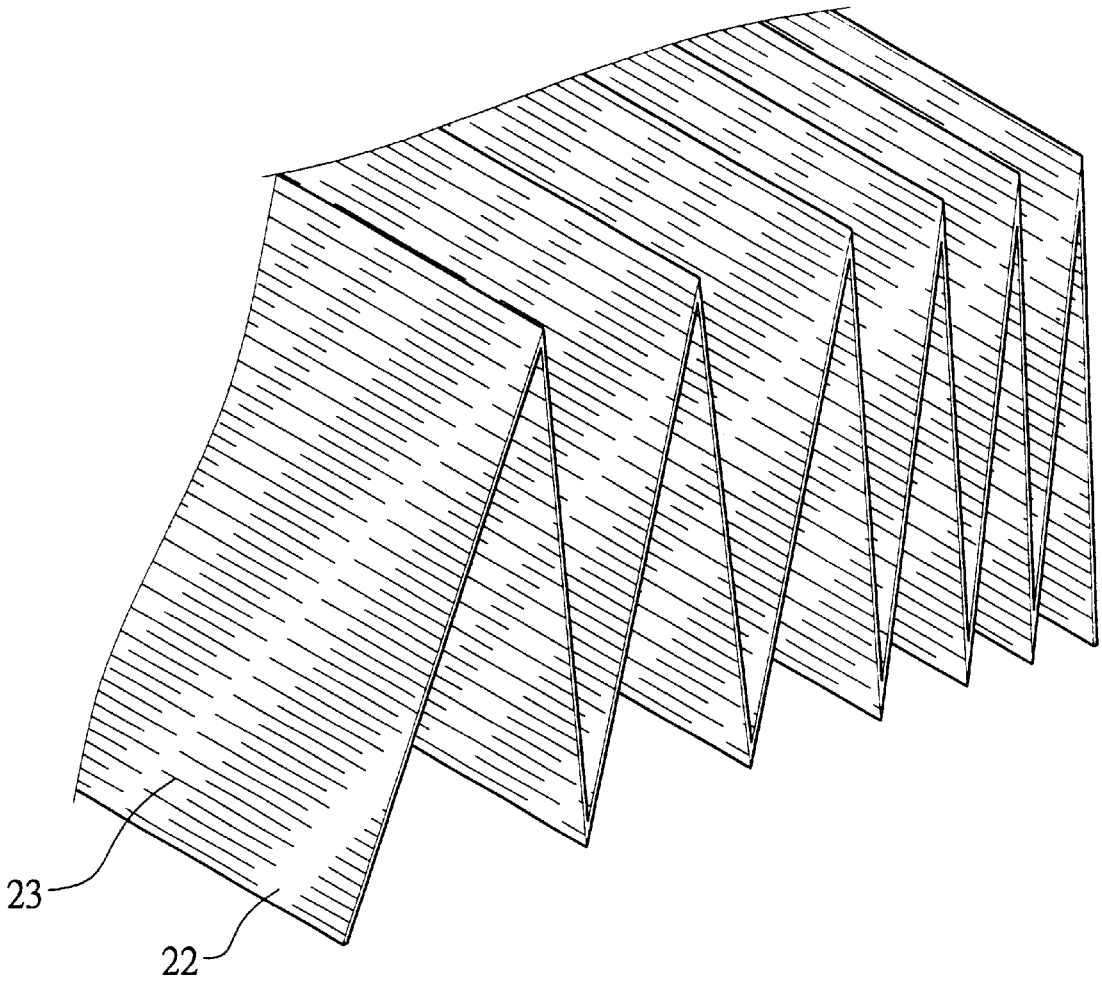
FIG. 5 is an illustrative view to show another embodiment of the sheet when the tip of the dart hits on the dart board, the tip is enclosed by the sheet without slits.

Referring to FIG. 5, the sheet of artificial material 22 may also be folded repeatedly to form tightly overlapped structure. The dart board can be composed by several unit of such overlapped sheets of artificial material 22. By the folded unit, the dart board is easily to be made as a polygonal shape such as a rectangular shape.

Figure 6:
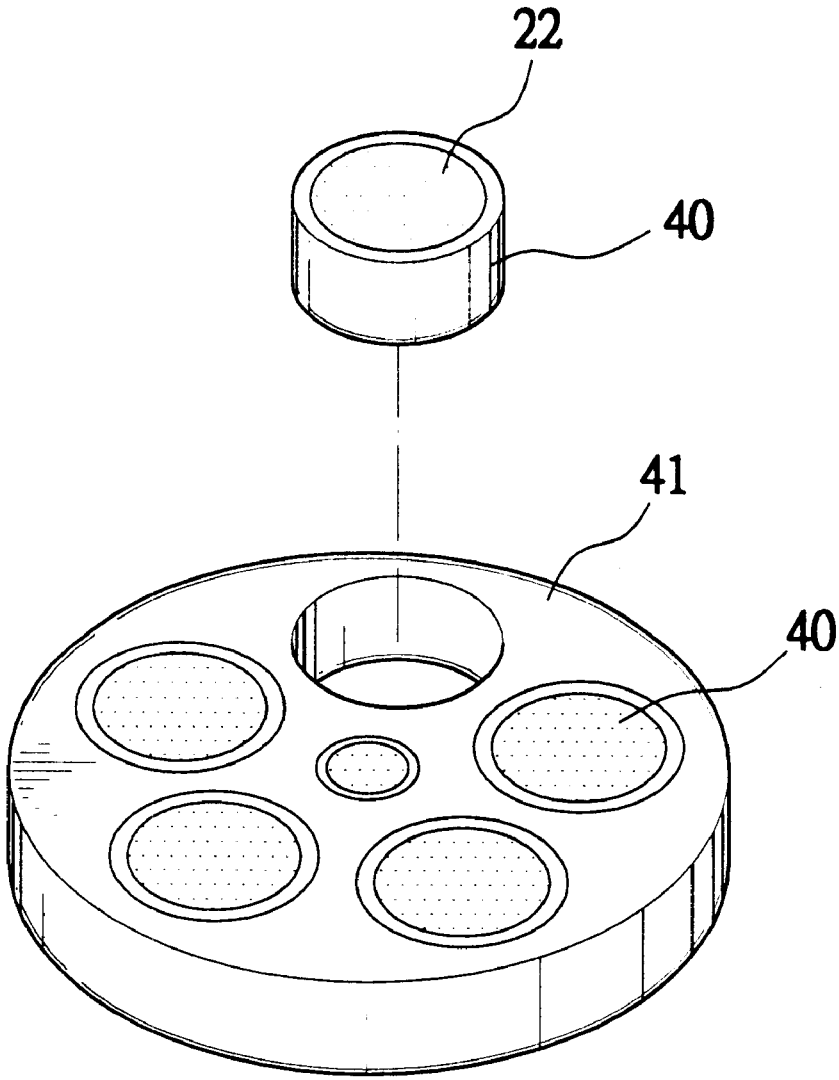
FIG. 6 is an exploded view to show another embodiment of the dart board in accordance with the present invention.
Figure 7:
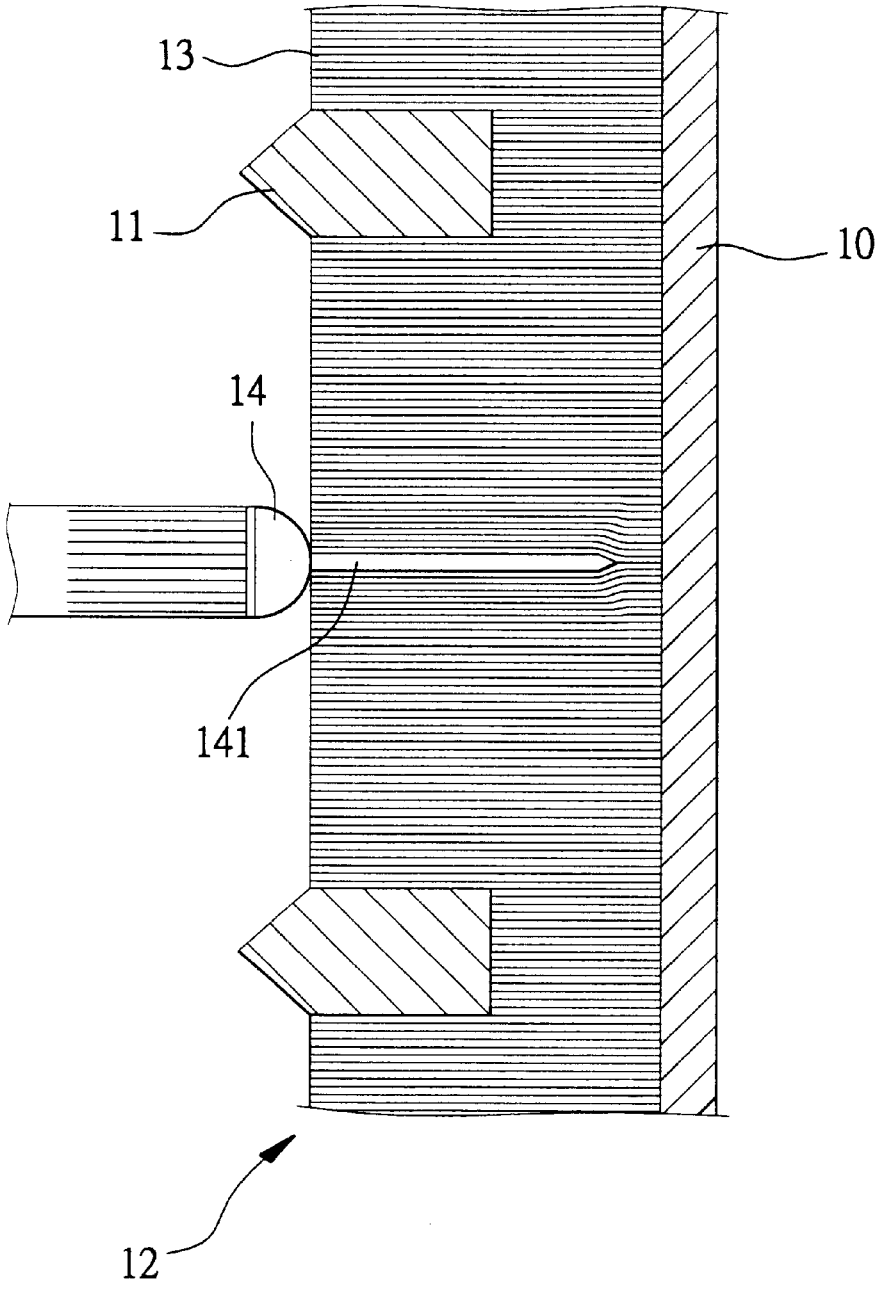
F I G.7 PRIOR ART
FIG. 7 is an illustrative view to show a conventional dart board and a dart hits on the conventional dart board.
Figure 8:
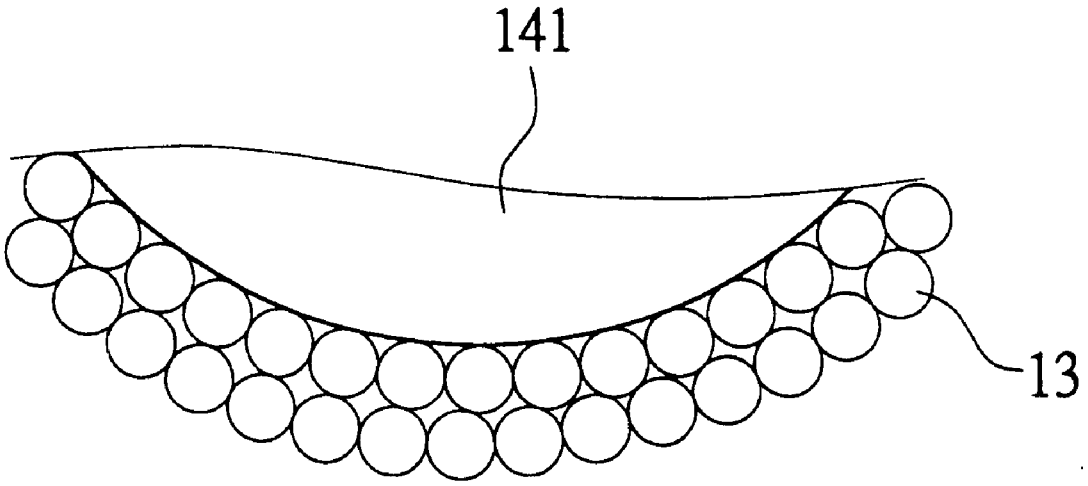
F I G.8 PRIOR ART
FIG. 8 is an illustrative view to show the tip of the dart contacts the fibers of the conventional dart board.

Referring to FIG. 6, the dart board 41 can be composed of six circular parts 40 and each part 40 includes a plurality of tubes 21 so as to divide the dart board into different partitions and each partition represents a score area.

The spirally wound sheet of artificial material can be made of transparent material so that a pattern card can be printed on the backing board 10 so that the players can see a pattern on the backing board 10.

The thickness of the sheet of artificial material 22 is so thin that it will not be damaged by the tip 31. Even if the tip 31 hits the dart board 20 at an angle, only minor part of the sheet artificial material 22 could be damaged and will not affect the feature of the tube 21.

While we have shown and described various embodiments in accordance with the present invention, it should be clear to those skilled in the art that further embodiments may be made without departing from the scope of the present invention.

What is claimed is:

1. A dart board comprising:

a backing board;

a plural of tightly overlapped sheets of artificial material each fixedly connected to said backing board at one end thereof; wherein:

each of said plurality of sheets of artificial material has a surface formed with multiple slits; and each of said multiple slits is longitudinally extended through said surface of each of said plurality of sheets of artificial material.

2. The dart as claimed in claim 1, wherein said slits are located alternately with each other.

3. The dart as claimed in claim 1, wherein said slits extend in a direction perpendicular to a surface of said backing board.

4. A dart board comprising:

a backing board;

a plurality of tubes each fixedly connected to said backing board at one end thereof and each including a spirally rolled sheet of artificial material; wherein:

said spirally rolled sheet of artificial material of each of said tubes has a surface formed with multiple slits; and each of said multiple slits is longitudinally extended through said surface of said spirally rolled sheet of artificial material of each of said tubes.

5. The dart as claimed in claim 4, wherein said slits are located alternately with each other.

6. The dart as claimed in claim 4, wherein said slits extend in a direction perpendicular to a surface of said backing board.

* * * * *